United States Patent [19]

Yagi

[11] 4,354,344

[45] Oct. 19, 1982

[54] METHOD OF MAKING SHACKLE

[75] Inventor: Kazutomo Yagi, Osaka, Japan

[73] Assignee: Kyoritsu Manufacturing Co., Ltd., Osaka, Japan

[21] Appl. No.: 138,995

[22] Filed: Apr. 10, 1980

[51] Int. Cl.[3] ..... B21L 13/00

[52] U.S. Cl. ..... 59/35 R; 59/27

[58] Field of Search ..... 59/15, 27, 35 R, 86; 76/101 D, 114; 72/360, 376; 101/4, 9, 21, 29; 81/DIG. 5

[56] References Cited

U.S. PATENT DOCUMENTS

| | | | |
|---|---|---|---|
| 741,914 | 10/1903 | Kirschbaum | 101/4 |
| 2,471,900 | 5/1949 | Robinson | 72/376 |
| 3,140,655 | 7/1964 | Lally | 101/4 |
| 3,848,312 | 11/1974 | Kirkham | 72/376 X |
| 4,079,584 | 3/1978 | Shahan | 59/35 R |
| 4,145,874 | 3/1979 | Muller et al. | 59/86 |

FOREIGN PATENT DOCUMENTS

| | | | |
|---|---|---|---|
| 4814 | 10/1979 | European Pat. Off. | 59/86 |
| 561372 | 4/1975 | Switzerland | 59/86 |

*Primary Examiner*—Howard N. Goldberg
*Attorney, Agent, or Firm*—Darby & Darby

[57] ABSTRACT

A method of making a shackle is disclosed. Both ends of a round bar are upset and are then formed into circular heads which are bored through. The round bar is later bent into a U at its middle part to form the shackle body, and the indicating letters are bulged out on the shackle body and surrounded by a depressed island.

3 Claims, 6 Drawing Figures

METHOD OF MAKING SHACKLE

This invention relates to making a shackle that indicates on its body its safety working load and its diameter or that has other indicia.

Because a shackle is put in use in slinging up heavy goods, its safety working load and diameter should be indicated on it. In conventional shackles, the indication has been made by press-making or by what is called all stamping in order to bulge out indicating letter alone through stamping the whole surface of the body in a die. The letters indicated on the shackle by press-marking have been liable to quickly become illegible, because they are engraved in the shackle body, and dust can accumulate in them. Further, the shackle has been susceptible to breakage in the engraved part, and liable to break below the indicated load. It has also been crooked around the press-marked part, and warped on the member surface reverse to the letter. In a shackle in which letters were made to bulge out by all-stamping, those letters were apt to be worn down by the wire rope threaded through the shackle to suspend heavy goods, since the letters protruded from the shackle body. Further, the necessity of forming the whole shackle member in dies required a large quantity of material and caused flashes to project from the parting line of the dies. Accordingly, machining was needed for removing those flashes. In addition, a great deal of pressure had to be applied while shifting the material for easily stamping the whole surface of the shackle member. Such an operation calls for a large-sized pressing machine which is not normally provided in small and medium forging factories.

Under these circumstances, the present invention has an object of providing a method of making a shackle.

DETAILED DESCRIPTION OF PREFERRED EMBODIMENTS

The invention will now be described in detail with reference to the concrete example shown in the accompanying drawings.

Figure 1:
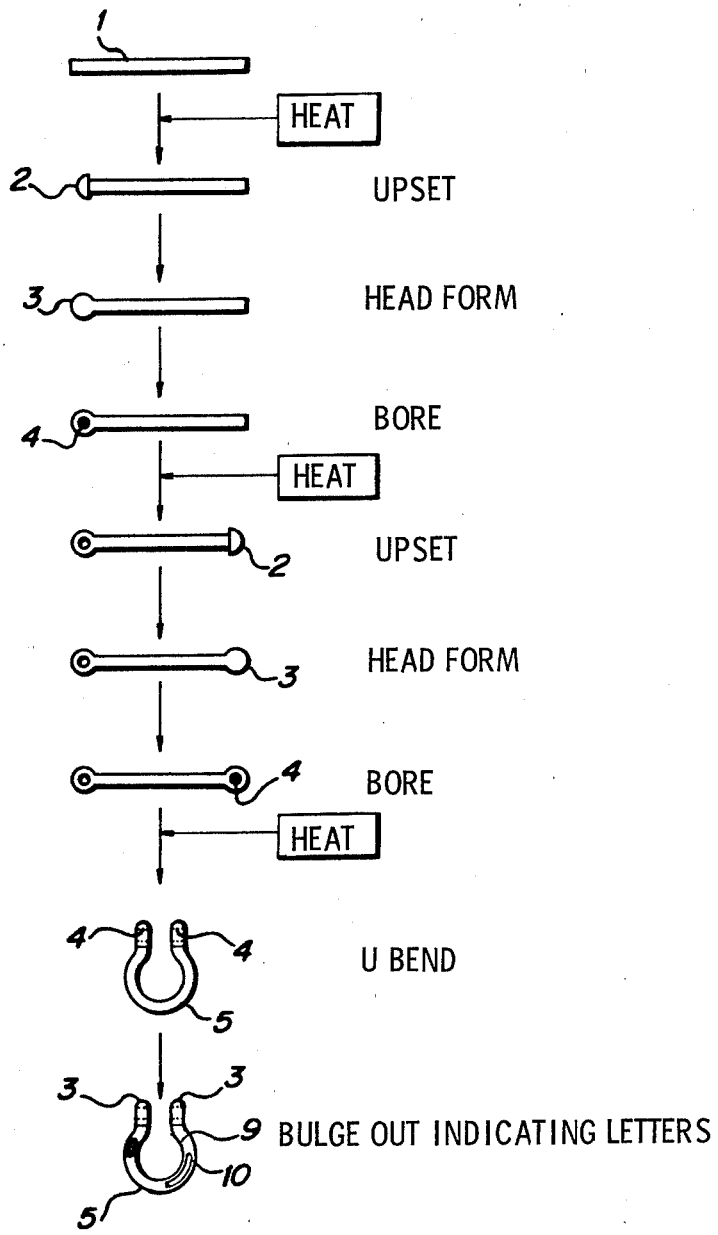
FIG. 1 is a schematic drawing of the invention.
Figure 3:
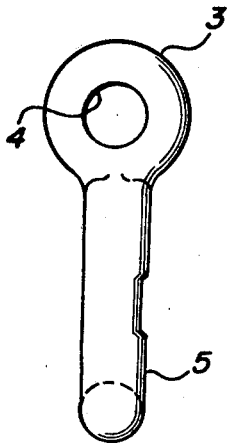
FIG. 3 is a left side view of the same shackle shown in FIG. 2.

As shown in FIG. 1, a round bar 1 cut to length is first heated. Then, one end is upset into a convex head 2, and a circular head 3 is formed therein by compression. In the central part of this head 3 is bored a through-hole 4 for a supporting pin. The other end of the bar is treated exactly the same way. Next, after being heated again, the middle part of the round bar thus formed is bent in a U-shape so that the through-holes 4 are aligned with each other. In this way, the shackle body 5 is completed.

Since the shackle is to be used for slinging up heavy goods, it is required that the safety working load and the diameter of the shackle body 5 be conspicuously indicated for reasons of safety. In the example shown, the safety working load is 6½ tons, and the diameter of the member of the shackle body 5 is ⅞ inches, indicated as: "SWL 6½T" and "⅞", respectively. These two indications are lettered separately on the left and right sides of the same face of the shackle.

Figure 2:
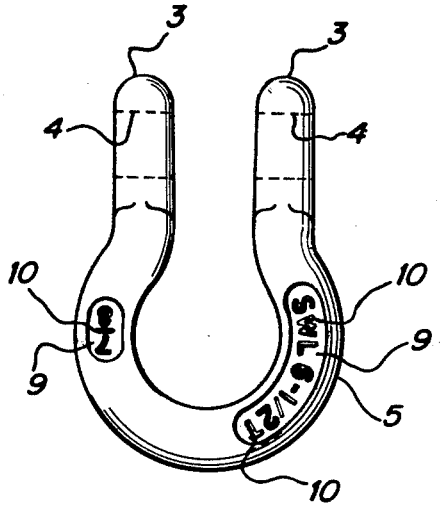
FIG. 2 is a front view of a shackle manufactured by the invention.
Figure 4:
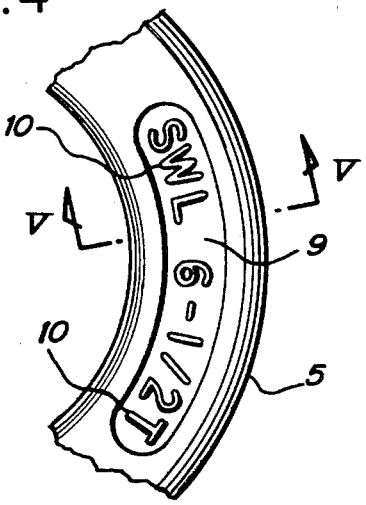
FIG. 4 is a partially cutaway enlarged front view of an important part of FIG. 2.
Figure 6:
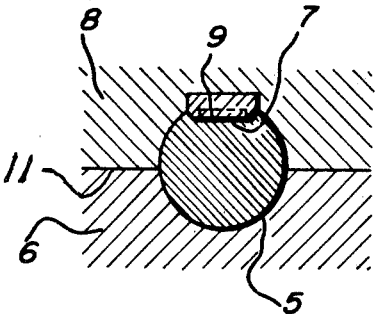
FIG. 6 is an explanatory view of the apparatus by which the indicating letters are made to bulge on the shackle.
Figure 5:
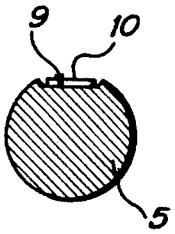
FIG. 5 is a cross-sectional view taken along the line V—V of FIG. 4.

The process of stamping the indicia: "SWL 6½ T" and "⅞" is as follows:

The formed shackle is placed horizontally (as shown in FIG. 2) between a lower die 6 and an upper die 8. The lower die 6 constrains the lower half of the shackle member, while the upper die 8 butts the whole surface of the upper half of the shackle member and similarly constrains it. Protruding from the butting face of the upper die 8 is a stamping plate 7 on which indicia are present in relief. The cooperation of these lower and upper dies 6, 8 permits stamping of the indicia. (See FIG. 6). The shackle, which is placed on the supporting concave surface of the lower die 6, is constrained over its whole surface by the lower and upper dies 6, 8 when the upper die 8 descends to stamp the indicia, whereby only the surrounding region is pressed by the stamping plate 7 without either deformation or strain. The indicia: "SWL 6½T" and "⅞" bulge out so as to compel the material to fill up the relief indicia engraved in the stamping plate 7 while the lower die 6 and the upper die 8 butt each other at the parting line 2.

The shackle will not become illegible due to the dust accumulated thereon, unlike other shackles which have the indication of letters through press-marking. Further, there is no danger or breakage below the indicated load caused by a fracture at a concave marking. While in shackles made by all-stamping the indicia are easily worn away, they are here free from obliteration because the wire rope threaded through the shackle does not touch them—they are surrounding by an island and do not protrude above it. In this case of shackles made by the press-marking method, it was necessary to correct the deformation and strain caused by local stamping without total restraint. On the contrary, the shackle according to the invention needs no corrective working inasmuch as the stamping of the indicia takes place while constraining the whole member. Furthermore, for shackles made by all-stamping, a great deal of material was needed for press marking the whole surface of the shackle while shifting the material except the indicating letter part; flashes projecting from the parting line of the forming dies has to be removed; and a large quantity of pressing power requiring a large pressing machine not normally provided in small and medium forging factories was needed. By contrast, in the shackle according to the invention, no flash results, only a small amount of material is needed, great pressing power is not required since only the indicating section is stamped, and accordingly a small-sized press which is ordinarily provided even in small and medium forging factories can be used. Moreover, since the indicia are surrounded by a sunken island, the appearance of the shackle according to the invention is preferable.

I claim:

1. A method of making a shackle, comprising the following steps:

providing an elongated round bar having two ends; heating the bar;

upsetting the ends of the bar into convex heads;

compressing the upset ends of the bar to form circular heads;

drilling holes in the centers of the circular heads;

bending the bar in a manner that the holes are aligned with each other to form a shackle;

providing a first die having a recess shaped to receive a first half of the shackle;

providing a stamping plate in which indicia are present in relief;

providing a second die having a recess shaped to receive the stamping plate in another half of the shackle;

inserting the stamping plate into the second die;

introducing the shackle between the second die and the first die; and closing the second die and first die upon the shackle and thereby causing the stamping plate to strike the surface of the second half of the shackle and stamp indicia in said surface thereof in a manner that the indicia are surrounded by an island and are unprotruding above said surface.

2. The method of claim 1, wherein said closing step further comprises the step of closing the second die and the first die upon each other.

3. The method of claim 1, further comprising the step of supporting the shackle over that part of its surface which is uncontacted by the stamping plate.

* * * * *